US009233817B2

(12) United States Patent
Davis et al.

(10) Patent No.: US 9,233,817 B2
(45) Date of Patent: Jan. 12, 2016

(54) WINCH APPARATUS

(71) Applicants: Adam Davis, Leola, PA (US); Steven Michelman, Las Vegas, NV (US); Scott Fisher, Las Vegas, NV (US)

(72) Inventors: Adam Davis, Leola, PA (US); Steven Michelman, Las Vegas, NV (US); Scott Fisher, Las Vegas, NV (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 141 days.

(21) Appl. No.: 13/836,051

(22) Filed: Mar. 15, 2013

(65) Prior Publication Data

US 2014/0264212 A1 Sep. 18, 2014

(51) Int. Cl.
*B66D 3/20* (2006.01)
*B66D 1/38* (2006.01)

(52) U.S. Cl.
CPC .. *B66D 3/20* (2013.01); *B66D 1/38* (2013.01); *Y10T 29/49465* (2015.01)

(58) Field of Classification Search
CPC ..... B66D 1/12; B66D 1/14; B66D 1/20; B66D 1/225; B66D 1/24; B66D 1/38
USPC ..... 254/342, 345, 346, 362, 371, 385
See application file for complete search history.

(56) References Cited

U.S. PATENT DOCUMENTS

| | | | | | |
|---|---|---|---|---|---|
| 2,930,585 | A * | 3/1960 | Reeves | B66D 1/20 | 254/358 |
| 3,226,089 | A * | 12/1965 | Patz | B66D 3/12 | 254/358 |
| 3,640,102 | A * | 2/1972 | Blount, Jr. | D06B 3/26 | 68/176 |
| 3,667,312 | A * | 6/1972 | Dahl | B66D 1/02 | 254/343 |
| 3,739,728 | A * | 6/1973 | Thompson | 104/173.2 | |
| 4,157,737 | A * | 6/1979 | Petracci | E02D 7/08 | 173/81 |
| 5,002,259 | A * | 3/1991 | Manning et al. | 254/350 | |
| 5,191,267 | A * | 3/1993 | Machacek | B65G 21/18 | 198/778 |
| 5,195,725 | A * | 3/1993 | Koopmans | B66D 1/00 | 254/266 |
| 5,273,257 | A * | 12/1993 | Perkins | B66D 1/18 | 254/323 |
| 7,419,204 | B2 * | 9/2008 | Coble et al. | 296/57.1 | |
| 9,156,665 | B2 * | 10/2015 | Yoder | B66D 3/20 | |
| 2002/0096672 | A1 * | 7/2002 | Merello et al. | 254/342 | |
| 2008/0083363 | A1 * | 4/2008 | Hart | B63B 35/815 | 114/253 |

* cited by examiner

*Primary Examiner* — Emmanuel M Marcelo
*Assistant Examiner* — Angela K Caligiuri
(74) *Attorney, Agent, or Firm* — McNees Wallace & Nurick LLC

(57) ABSTRACT

Provided is a winch apparatus including two exchangeable and interchangeable gears connecting a motor to a drum, the drum being operative to extend and retract a flexible line. By exchanging and interchanging the gears to effect a change in the ratio of the diameters of the first gear to the second gear, the torque and the linear speed of the flexible line are adjustable, permitting the same winch apparatus to move heavier loads at lower speeds, or lighter loads at higher speeds.

28 Claims, 6 Drawing Sheets

WINCH APPARATUS

FIELD

The disclosure is generally related to a motorized winch apparatus for positioning a load. More particularly, the disclosure includes a motorized winch apparatus capable of variable torque/speed configurations for manipulating staging equipment.

BACKGROUND

At events such as concerts or theatre productions, winches are commonly used for support, movement and manipulation of performers and various equipment, such as, lighting, sound, scenery and props. Winches are selected based on specifications such as the weight of a load to be moved and the speed at which the load must be moved. Winches with higher torque are needed for heavier loads; however, higher torque winches have lower speeds at which the load may be moved in order to provide the higher torque. Winches with higher speeds are needed for loads which must be moved quickly; however, high speed winches sacrifice torque in order to provide the higher speed. Winches are generally only suitable to provide a particular combination of torque and speed (high torque/low speed, intermediate torque/intermediate speed, or high speed/low torque). As such, additional winches must be kept on hand in the event that a different torque/speed profile is needed. Keeping additional winches on hand is an expensive proposition, as the cost of the spare winches must be considered as well as the cost of maintenance of the spare winches.

What is needed is a winch apparatus and method of adjusting a winch apparatus that do not suffer from one or more of the above drawbacks in the art.

SUMMARY

An aspect of embodiments of the present disclosure includes a system that provides a winch apparatus for manipulating loads associated with public performances, such as performers and staging equipment.

In an exemplary embodiment, a winch apparatus is provided. The winch apparatus includes a gear set and a motor. The gear set includes a first gear having a first diameter and a second gear having a second diameter. The first diameter and the second diameter have a ratio. The motor is operative through a drive belt to provide a torque that translates a length of at least one flexible line at a linear speed. The torque and the linear speed are adjustable by altering the ratio of the first diameter to the second diameter.

In a further exemplary embodiment, a method for adjusting torque and speed of a winch apparatus is provided. The method includes providing the winch apparatus, removing at least one of the first gear and the second gear from the winch, and replacing the removed first or second gear with a replacement gear. The winch apparatus includes a gear set and a motor. The gear set includes a first gear having a first diameter and a second gear having a second diameter, the first diameter and the second diameter having a ratio and a motor. The motor is operative through a drive belt to provide a torque that translates a length of at least one flexible line at a linear speed. The torque and the linear speed are adjustable by altering the ratio of the first diameter to the second diameter removing at least one of the first gear and the second gear from the winch.

The step of replacing the removed first or second gear with the replacement gear alters the ratio of the first diameter to the second diameter.

Further aspects of the method and system are disclosed herein. The features as discussed above, as well as other features and advantages of the present disclosure, will be appreciated and understood by those skilled in the art from the following detailed description and drawings.

DETAILED DESCRIPTION

Winches are used to create a variety of effects in the entertainment industry, such as, but not limited to, flying cameras, flying people or objects, lifting people or objects, suspending and moving lighting or other staging equipment.

Figure 1:
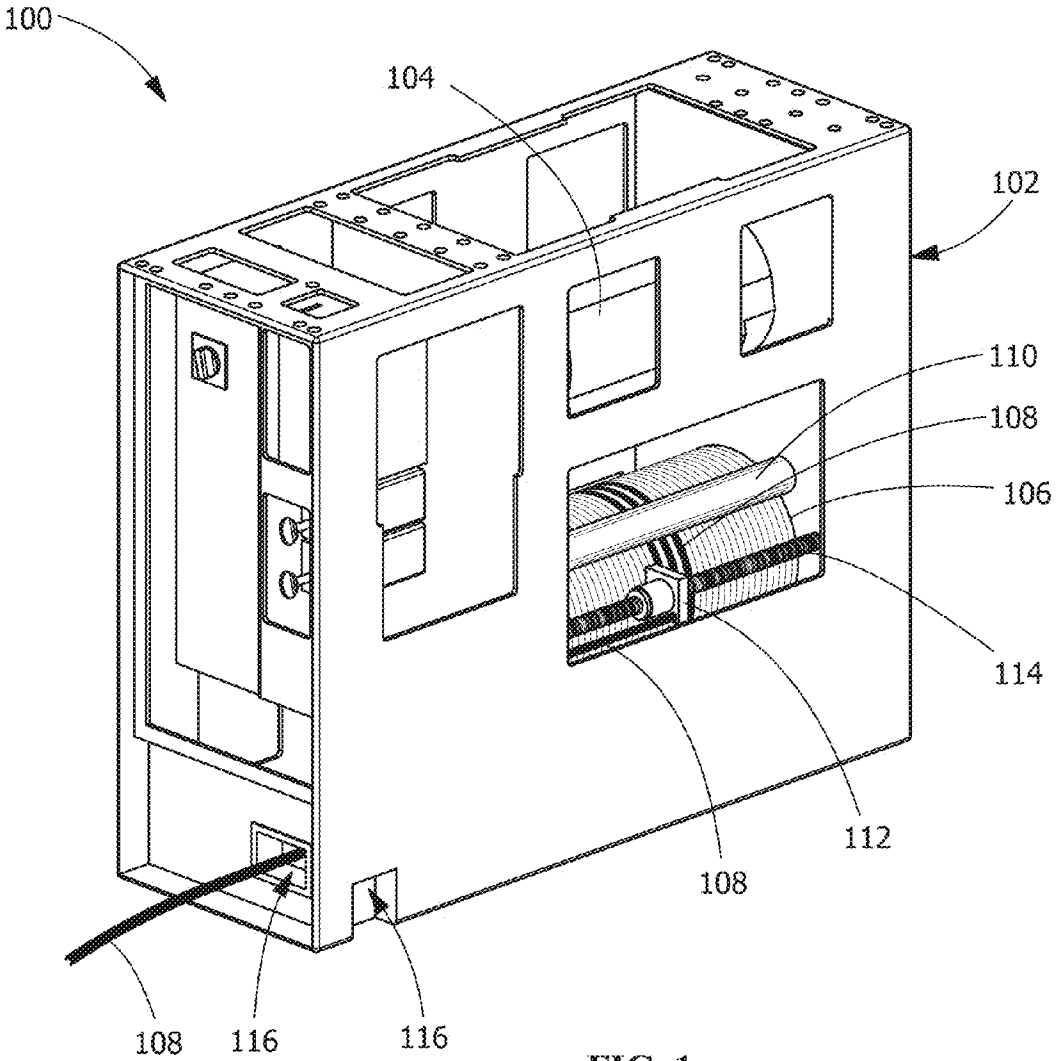
FIG. 1 is a front left perspective view of a winch apparatus according to an exemplary embodiment of the disclosure.

FIG. 1 shows a front left perspective view of a winch apparatus 100 according to an exemplary embodiment of the disclosure. A winch frame 102 encloses winch apparatus 100. Enclosed within winch frame 102 is a motor 104 which causes a drum 106 to rotate to spool or unspool at least one flexible line 108 wrapped about drum 106. In one embodiment, flexible line 108 is, but not limited to, wire, wire rope, wire cable, filament, string, cord, rope, or combinations thereof. A pinch roller 110 is held in close proximity to drum 106 to ensure that flexible line 108 spools and unspools onto or off of drum 106 smoothly, with the aid of a fairlead 112 moving along a fairlead screw 114. Flexible line 108 is drawn into or extended from winch frame 102 through a plurality of flexible line pass through locations 116. During operation of winch apparatus 100, flexible line 108 passes through fairlead 112 turning at an approximate right angle so as to spool or unspool smoothly onto or off of drum 106. As flexible line 108 spools or unspools, fairlead screw 114 turns, moving fairlead 112 adjacent to drum 106 such that flexible line 108 is always being drawn onto or off of the drum 106 at near to a right angle, preventing flexible line 108 from slipping or becoming tangled.

Figure 2:
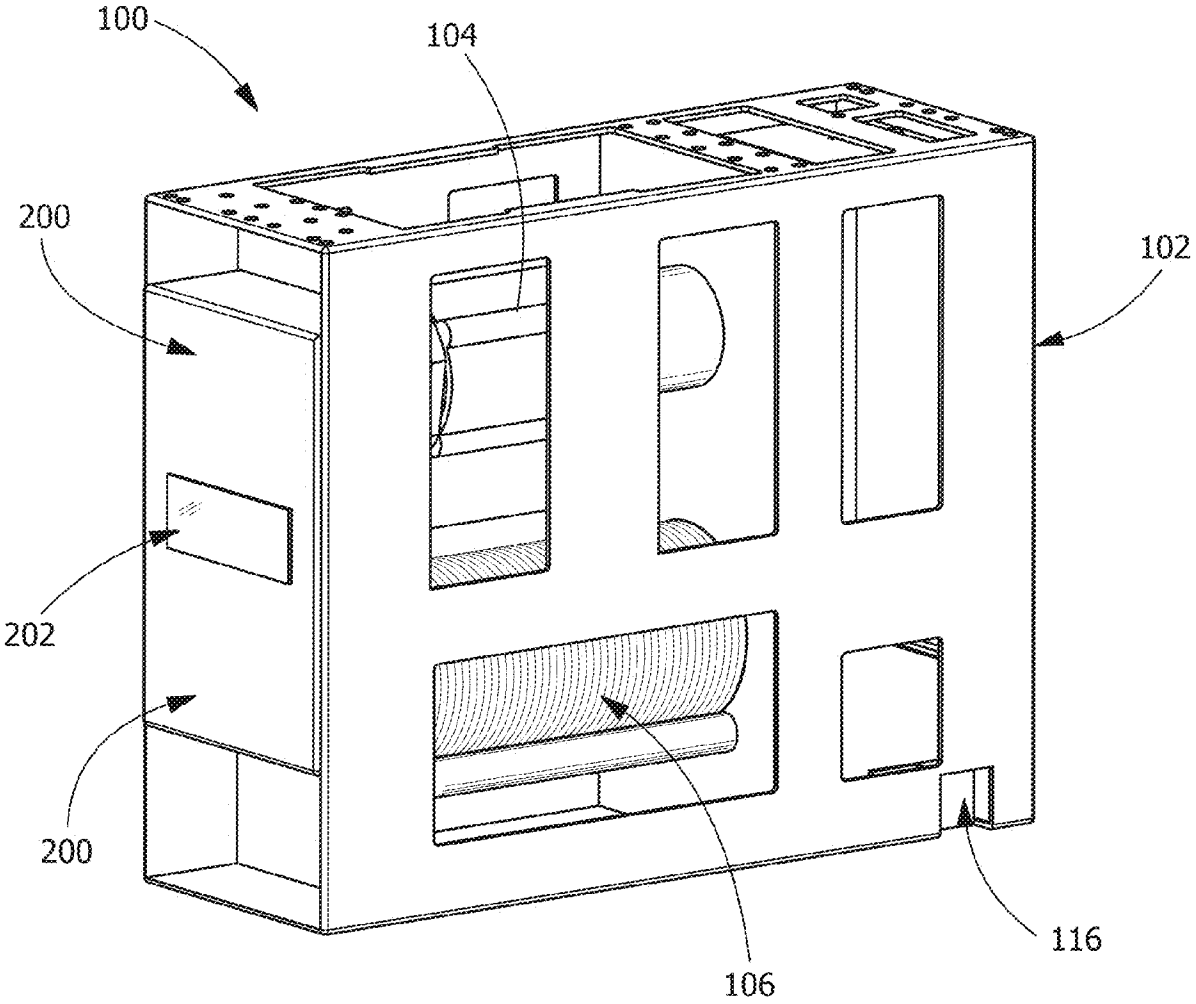
FIG. 2 is back right perspective view of the winch apparatus of FIG. 1 according to an exemplary embodiment of the disclosure.

FIG. 2 is a back right perspective view of winch apparatus 100 of FIG. 1 according to an exemplary embodiment of the disclosure. A gear set cover plate 200 and drive belt sight window 202 form the exterior of one end of winch frame 102.

Figure 3:
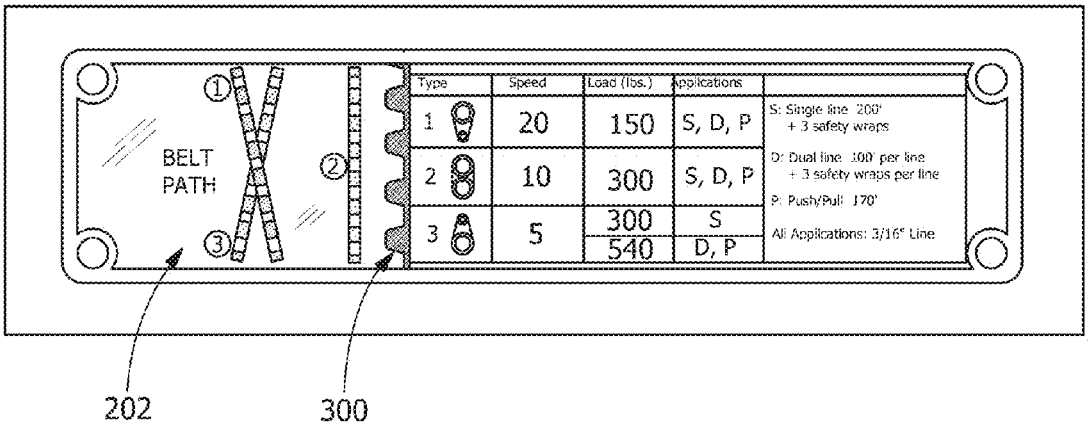
FIG. 3 shows the drive belt sight window of the winch apparatus of FIG. 1 according to an exemplary embodiment of the disclosure.

FIG. 3 illustrates drive belt sight window 202 of winch apparatus 100. A drive belt 300 is visible through drive belt sight window 202, which permits the angle of the path of drive belt 300 to be observed without removing gear set cover plate 200. Drive belt 300 connects motor 104 to drum 106.

Figure 4:
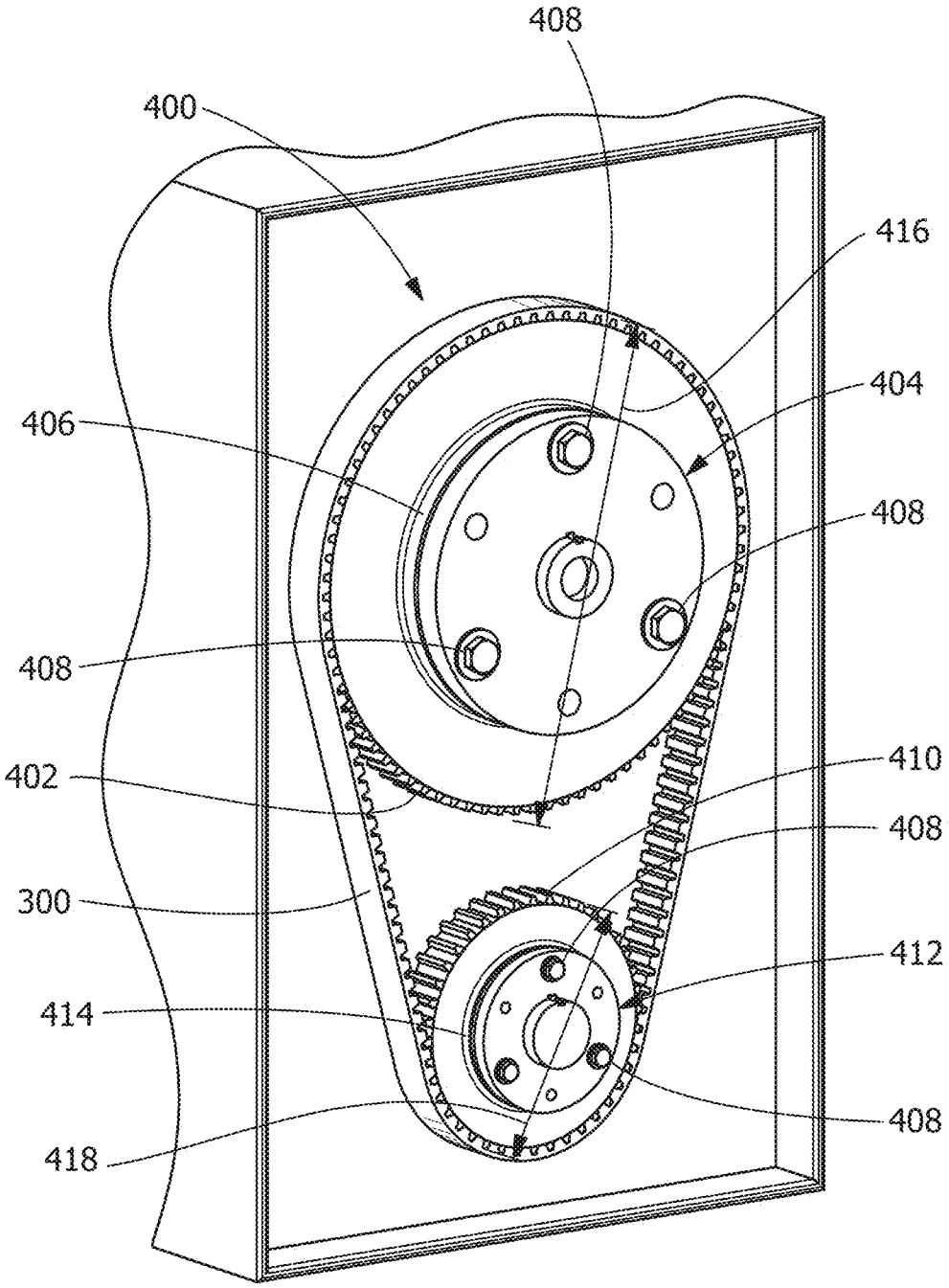
FIG. 4 shows the exposed gear set and drive belt of the winch apparatus of FIG. 1 where the ratio of the diameter of the first gear to the diameter of the second gear is about 2:1 according to an exemplary embodiment of the disclosure.

FIG. 4 shows gear set 400 and drive belt 300 of winch apparatus 100 when gear set cover plate 200 is removed from winch frame 102. Removably attached to motor 104 is a first gear 402, which is secured by a first retainer bushing 404. Between motor 104 and first gear 402 is a first washer 406, and this assemblage is held in place by a plurality of bolts 408. Drive belt 300 is engaged around first gear 402 and a second gear 410. Second gear 410 is secured to drum 106 by a second retainer bushing 412. Between drum 106 and second gear 410 is a second washer 414, and this assemblage is held in place with a plurality of bolts 408. Motor 104, through gear set 400, operates to rotate drum 106, thereby extending or withdrawing at least one flexible line 108 from winch apparatus 100. First gear 402 and second gear 410 are removable by an end-user of winch apparatus 100. First gear 402 has a first diameter 416, and second gear 410 has a second diameter 418. In one embodiment, first gear 402 and second gear 410 may be interchanged with one another or exchanged with an additional gear or gears (not shown). By interchanging or exchanging first gear 402 and second gear 410 with each other or with an additional gear or gears, the ratio of first diameter 416 to second diameter 418 may be altered.

Figure 5:
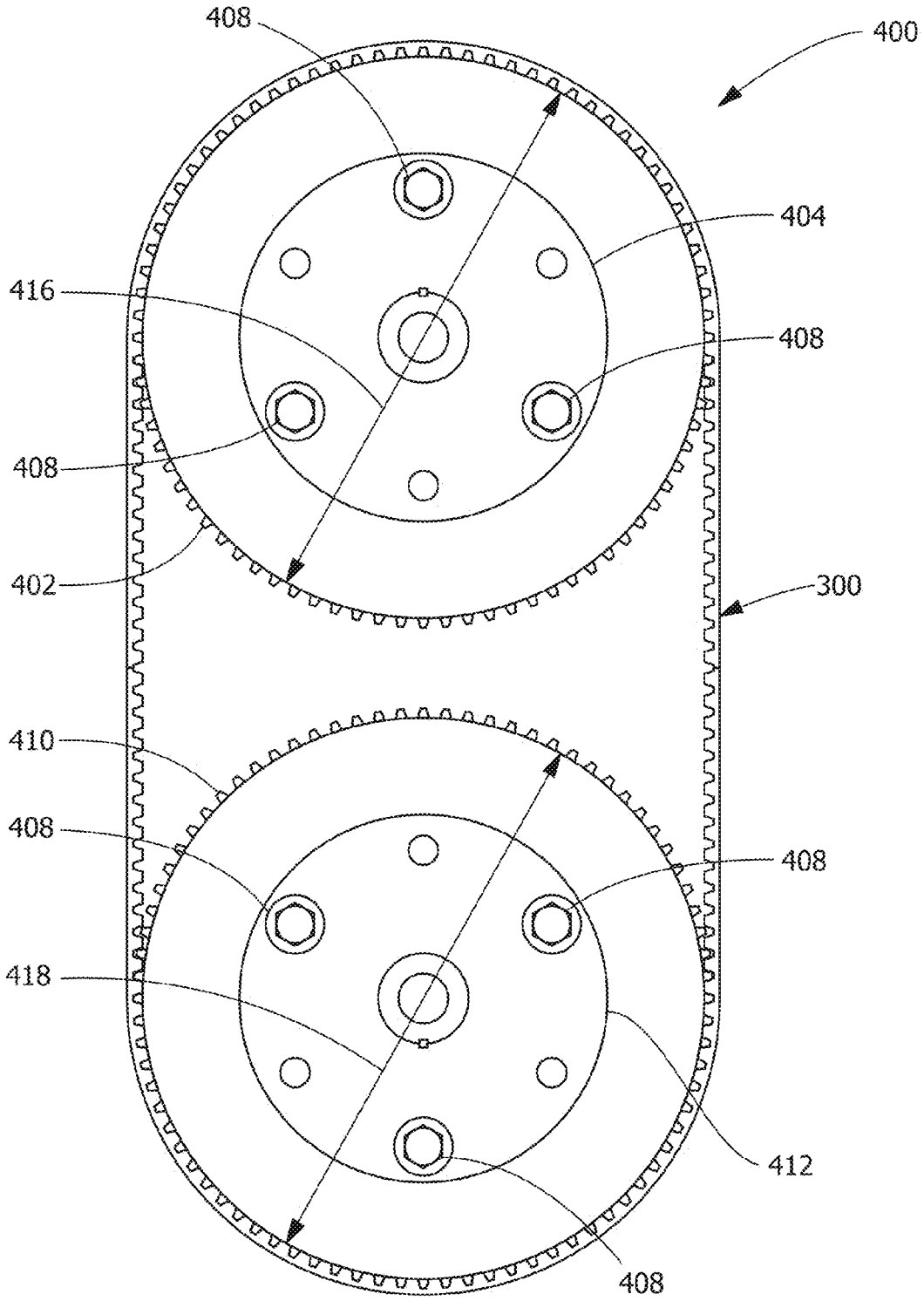
FIG. 5 shows gear set and drive belt of the winch apparatus of FIG. 1 where the ratio of the diameter of the first gear to the diameter of the second gear is about 1:1 according to an exemplary embodiment of the disclosure.

When first gear 402 and second gear 410 are selected such that first diameter 416 and second diameter 418 are about the same (i.e., the ratio of first diameter 416 to second diameter 418 is about 1:1) (see FIG. 5), an intermediate torque is effected on drum 106 by motor 104, producing an intermediate linear speed of flexible line 108. By way of example only, in this exemplary embodiment of the disclosure, with a ratio of first diameter 416 to second diameter 418 of about 1:1, winch apparatus 100 produces a torque operative to move a load weighing in the range of about 250 pounds to about 300 pounds at a linear speed of up to about 5 feet per second to about 10 feet per second. In a preferred embodiment of the disclosure, wherein 3/16 inch wire rope is used for flexible line 108, and with a ratio of first diameter 416 to second diameter 418 of about 1:1, winch apparatus 100 produces a torque operative to move a load of up to about 300 pounds at a linear speed of up to about 10 feet per second.

Figure 6:
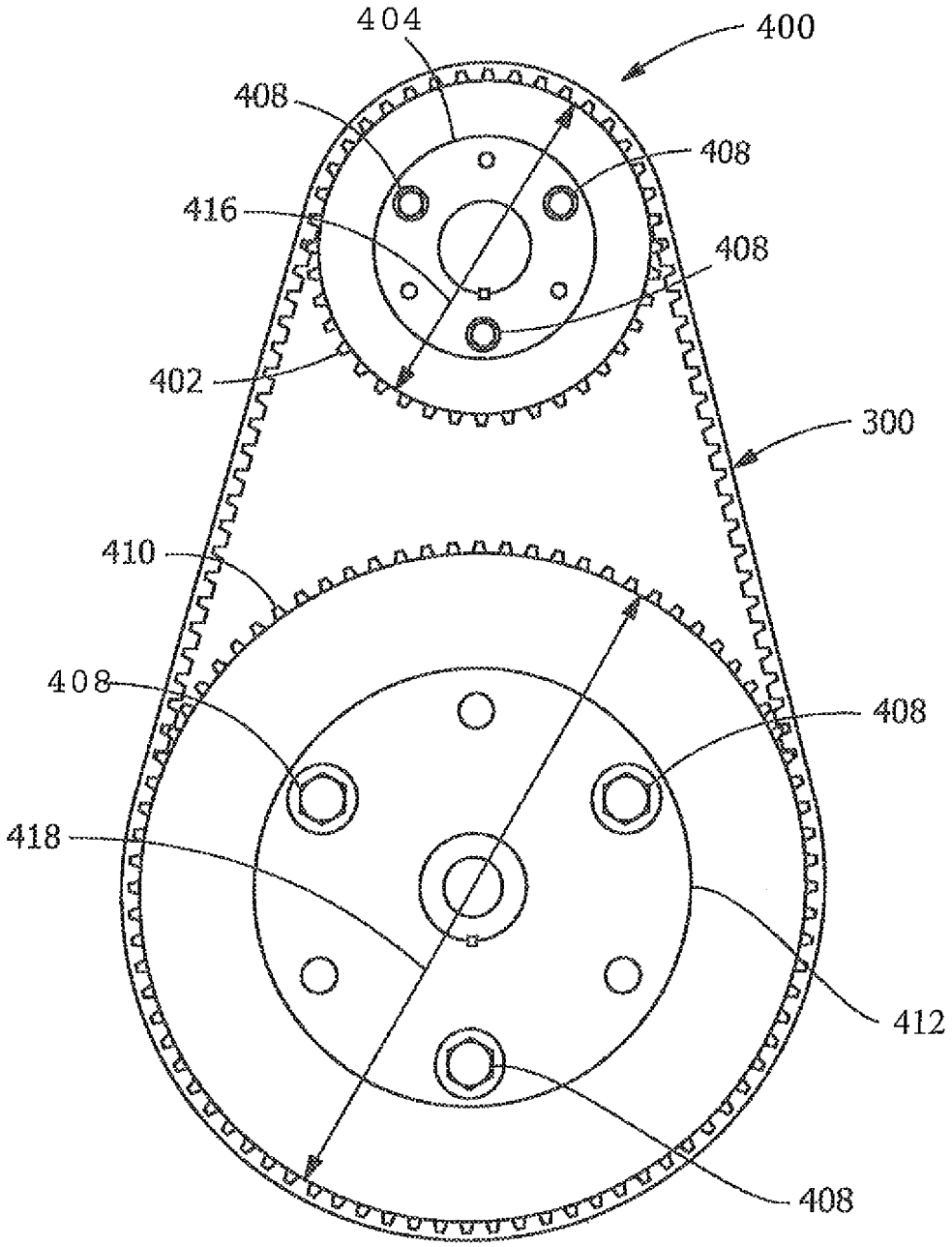
FIG. 6 shows gear set and drive belt of the winch apparatus of FIG. 1 where the ratio of the diameter of the first gear to the diameter of the second gear is about 1:2 according to an exemplary embodiment of the disclosure.

When first gear 402 and second gear 410 are selected such that first diameter 416 is about one-half of second diameter 418 (i.e., the ratio of first diameter 416 to second diameter 418 is about 1:2) (see FIG. 6), a higher torque is effected on drum 106 by motor 104, producing a lower linear speed of flexible line 108. By way of example only, in this exemplary embodiment of the disclosure, with a ratio of first diameter 416 to second diameter 418 of about 1:2, winch apparatus 100 produces a torque operative to move a load weighing in the range of about 500 pounds to about 600 pounds at a linear speed of up to about 3 feet per second to about 8 feet per second. In a preferred embodiment of the disclosure, wherein 3/16 inch wire rope is used for flexible line 108, and with a ratio of first diameter 416 to second diameter 418 of about 1:2, winch apparatus 100 produces a torque operative to move a load of up to about 600 pounds at a linear speed of up to about 5 feet per second wherein a single flexible line 108 is employed, or a load of up to about 540 pounds at a linear speed of up to about 5 feet per second wherein two flexible lines 108 are employed or a single flexible line 108 is employed in a push/pull configuration.

When first gear 402 and second gear 410 are selected such that first diameter 416 is about double second diameter 418 (i.e., the ratio of first diameter 416 to second diameter 418 is about 2:1) (see FIG. 4), a lower torque is effected on drum 106 by motor 104, producing a higher linear speed of flexible line 108. By way of example only, in this exemplary embodiment of the disclosure, with a ratio of first diameter 416 to second diameter 418 of about 2:1, winch apparatus 100 produces a torque operative to move a load weighing in the range of about 100 pounds to about 200 pounds at a linear speed of up to about 15 feet per second to about 25 feet per second. In a preferred embodiment of the disclosure, wherein 3/16 inch wire rope is used for flexible line 108, and with a ratio of first diameter 416 to second diameter 418 of about 1:2, winch apparatus 100 produces a torque operative to move a load of up to about 150 pounds at a linear speed of up to about 20 feet per second.

The foregoing embodiments and preferred embodiments present load weights and linear speeds based on motor 104 operating at 100% rated current and speed as well as a safety factor for flexible line 108. Greater load weights and linear speeds are enabled by improving the material characteristics of flexible line 108 and rated power of motor 104, as well as by providing greater than 100% of the rated current for motor 104 or exceeding 100% of the rated speed, which is possible for some periods of time. However, exceeding normal operating parameters must be at the discretion of the operator with a view to governing safety regulations.

By selecting first gear 402 and second gear 410 to result in different ratios of first diameter 416 to second diameter 418, the torque/speed profile is adjustable to fine-tune winch apparatus 100 for a wide variety of specific needs, including ensuring that the maximum speed is available for moving a particular load with a particular weight. Ratio of diameters between first gear 402 and second gear 410 is varied by substituting either first gear 402 or second gear 410 with a replacement gear having a predetermined diameter. The predetermined diameter is greater than or less than that of the removed first gear 402 or second gear 410, depending on the desired torque/speed profile.

It is important to note that the construction and arrangement of the present application, as shown in the various exemplary embodiments, is illustrative only. Only certain features and embodiments of the invention have been shown and described in the application and many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation-specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A winch apparatus comprising:

a gear set enclosed within a winch frame having a removable gear set cover plate overlying the gear set and an observation window forming an exterior of one end of the winch frame, the gear set including a first gear having a first diameter and a second gear having a second diameter, the first diameter and the second diameter having a ratio; and a motor, wherein the motor is operative through a drive belt to provide a torque that translates a length of at least one flexible line at a linear speed, and wherein the torque and the linear speed are adjustable by altering the ratio of the first diameter to the second diameter;

wherein the observation window is operable to permit determination of the ratio of the first diameter to the second diameter by at least permitting an angle of the drive belt extending between the first gear and the second gear to be observable.

2. The winch apparatus of claim 1, wherein the ratio of the first diameter to the second diameter is adjustable by interchanging the first gear and the second gear.

3. The winch apparatus of claim 1, wherein the ratio of the first diameter to the second diameter is adjustable by exchanging at least one of the first gear or the second gear with an at least one additional gear having a predetermined diameter.

4. The winch apparatus of claim 3, wherein the predetermined diameter of the at least one additional gear is about half the diameter of the unexchanged first gear or second gear.

5. The winch apparatus of claim 1, wherein the first diameter and the second diameter are about equal.

6. The winch apparatus of claim 5, wherein the torque moves a load weighing up to about 200 pounds to about 300 pounds.

7. The winch apparatus of claim 6, wherein the linear speed is up to about 5 feet per second to about 10 feet per second.

8. The winch apparatus of claim 1, wherein the first diameter is about one-half of the second diameter.

9. The winch apparatus of claim 8, wherein the torque moves a load weighing up to about 500 pounds to about 600 pounds.

10. The winch apparatus of claim 1, wherein the linear speed is up to about 3 feet per second to about 8 feet per second.

11. The winch apparatus of claim 1, wherein the first diameter is about double the second diameter.

12. The winch of apparatus claim 11, wherein the torque moves a load weighing up to about 100 to about 200 pounds.

13. The winch apparatus of claim 11, wherein the linear speed is up to about 15 feet per second to about 25 feet per second.

14. A method for adjusting torque and linear speed of a winch apparatus comprising:

providing the winch apparatus, the winch apparatus including:

a gear set enclosed within a winch frame having a removable gear set cover plate overlying the gear set and an observation window forming an exterior of one end of the winch frame, the gear set including a first gear having a first diameter and a second gear having a second diameter, the first diameter and the second diameter having a ratio, wherein the observation window is operable to permit determination of the ratio of the first diameter to the second diameter by at least permitting an angle of the drive belt extending between the first gear and the second gear to be observable; and a motor, wherein the motor is operative through a drive belt to provide the torque that translates a length of at least one flexible line at the linear speed, and wherein the torque and the linear speed are adjustable by altering the ratio of the first diameter to the second diameter;

removing at least one of the first gear and the second gear from the winch; and replacing the removed first or second gear with a replacement gear having a diameter different than the removed first or second gear, wherein the replacement gear alters the ratio of the first diameter to the second diameter.

15. The method of claim 14, wherein the replacement gear has a diameter greater than the diameter of the removed first or second gear.

16. The method of claim 14, wherein the replacement gear has a diameter less than the diameter of the removed first or second gear.

17. The method of claim 14, wherein the ratio of the first diameter to the second diameter is about 1:2.

18. The method of claim 14, wherein the ratio of the first diameter to the second diameter is about 2:1.

19. The method of claim 14, wherein the ratio of the first diameter to the second diameter is about 1:1.

20. A winch apparatus comprising:

a gear set enclosed within a winch frame having a removable gear set cover plate overlying the gear set and an observation window forming an exterior of one end of the winch frame, the gear set including a first gear having a first diameter and a second gear having a second diameter, the first diameter and the second diameter having a ratio; and a motor, wherein the motor is operative through a drive belt to provide a torque that translates a length of at least one flexible line at a linear speed, and wherein the torque and the linear speed are adjustable by altering the ratio of the first diameter to the second diameter;

wherein the drive belt having a pair of belt paths extending between the first gear and the second gear, each belt path of the pair of belt paths defining an angle between the first gear and the second gear;

wherein the observation window is arranged and disposed to permit a view of at least one belt path of the pair of belt paths, the view through the observation window permits an observer to determine the ratio based upon the view of the at least one belt path of the pair of belt paths through the observation window and indicia thereon.

21. The winch apparatus of claim 20, wherein the observation window includes indicia of the at least one belt path for each gear set ratio of a plurality of different gear set ratios.

22. The winch apparatus of claim 20, wherein the observation window is at least partially surrounded by the gear set cover plate.

23. The winch apparatus of claim 20, wherein the observation window is integral with the gear set cover plate.

24. The winch apparatus of claim 20, wherein the observation window includes indicia of a plurality of schematics showing a plurality of gear sets having different ratios, each of the gear sets engaged with a corresponding drive belt.

25. The winch apparatus of claim 24, wherein the observation window includes indicia of a plurality of operating parameters associated with each gear set/drive belt schematic.

26. The winch apparatus of claim 25, wherein the operating parameters correspond to the torque and the linear speed for each gear set/drive belt schematic.

27. The winch apparatus of claim 25, wherein the operating parameters include a load, a linear speed of the load, and the application corresponding to each gear set/drive belt schematic.

28. The winch apparatus of claim 25, wherein the plurality of operating parameters are displayed in a tabular format.

* * * * *